US005215436A

United States Patent [19]

Puzyrewski

[11] Patent Number: 5,215,436

[45] Date of Patent: Jun. 1, 1993

[54] INLET CASING FOR STEAM TURBINE

[75] Inventor: Romuald Puzyrewski, Gdansk, Poland

[73] Assignee: Asea Brown Boveri Ltd., Baden, Switzerland

[21] Appl. No.: 795,763

[22] Filed: Nov. 21, 1991

[30] Foreign Application Priority Data

Dec. 18, 1990 [CH] Switzerland ..... 4045/90

[51] Int. Cl.[5] ..... F01D 9/06

[52] U.S. Cl. ..... 415/202; 415/182.1

[58] Field of Search ..... 415/182.1, 202, 183, 415/184, 144, 116

[56] References Cited

U.S. PATENT DOCUMENTS

| | | | |
|---|---|---|---|
| 3,173,656 | 3/1965 | Du Preez | 415/144 |
| 3,829,235 | 9/1974 | Woollenweber | 415/182.1 |
| 4,141,672 | 2/1979 | Wieland et al. | 415/202 |
| 4,615,657 | 10/1986 | Kreitmeier | 415/144 |
| 4,648,791 | 3/1987 | Kreitmeier | 415/116 |

FOREIGN PATENT DOCUMENTS

| | | | |
|---|---|---|---|
| 172375 | 6/1906 | Fed. Rep. of Germany . | |
| 895293 | 11/1953 | Fed. Rep. of Germany . | |
| 2351249 | 12/1977 | France . | |
| 0265283 | 10/1984 | Switzerland | 415/182.1 |
| 654525 | 2/1986 | Switzerland . | |
| 654625 | 2/1986 | Switzerland . | |
| 16249 | 11/1909 | United Kingdom . | |

OTHER PUBLICATIONS

Dr. Walter Traupel, Thermische Turbomaschinen, Erster Band Thermodynamisch-Stromungstechnische Berechnung, Springer-Verlag Berlin/Heidelberg/New York, 1966, pp. 146, 147 & 475 (Cover Page).

BBC Brown Boveri, pp. 1-10, "Eingehausige Dampfturbinen Mittlerer Leistung fur Kraftwerke und Industriebetriebe".

*Primary Examiner*—John T. Kwon
*Assistant Examiner*—Mark Sgantzos
*Attorney, Agent, or Firm*—Oblon, Spivak, McClelland, Maier & Neustadt

[57] ABSTRACT

In a single-flow steam turbine, the inlet casing is designed to comprise two intertwined spiral casings (1, 2). These spirals have concentrically arranged annular openings (1',2') which face the inlet to the blading and extend over 360° of the circumference. The spirals can be shut off and/or throttled, allowing infinitely variable partial admission to the reaction admission (sic) (13, 14, 15). The spirals (2) dimensioned for the smaller flow and their annular opening (2') is arranged on the rotor side in the radial direction. The first row of blading supplied from the annular openings (1', 2') is an after the (sic) action control wheel (13). The radially inner boundary wall of the spiral dimensioned for the small flow is arranged in the plane of the balance piston.

4 Claims, 1 Drawing Sheet

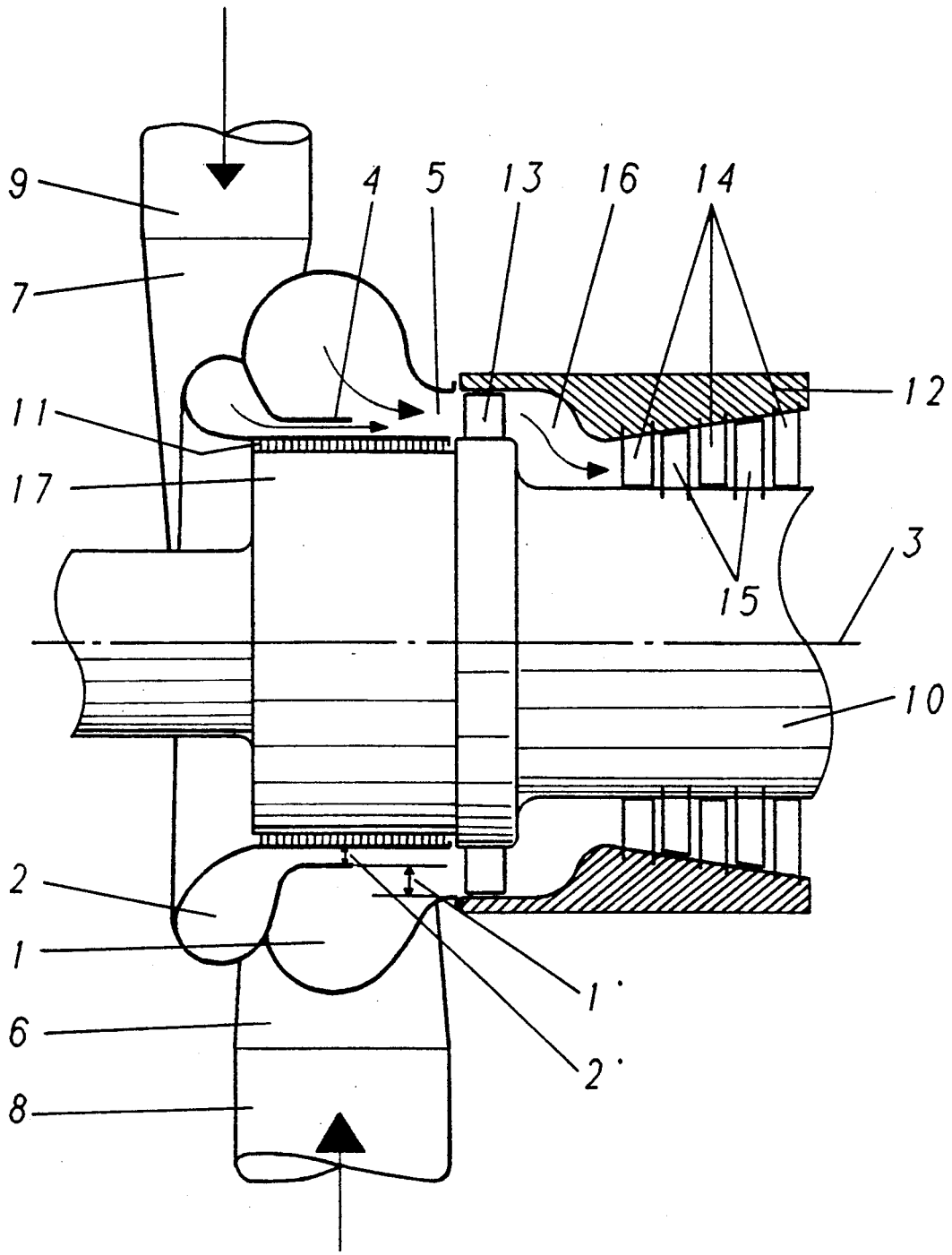
9
7
11
17
4
5
13
16
14
12
3
15
10
2
1
6
8
1'
2'

INLET CASING FOR STEAM TURBINE

TECHNICAL FIELD

The invention relates to an inlet casing for a single-flow, axial-flow high-pressure steam turbine, the flow to the first stage of which is from two mutually separated concentric annular openings, each annular opening being connected to its own inflow line, the inflow lines being two concentrically arranged spiral casings which can be shut off or throttled separately and are provided on the outlet side with annular openings extending over 360°, the spiral cross-section of both spirals furthermore being designed to produce an angular momentum over the entire circumference, such that the working medium flowing out of the annular openings has, irrespective of the load under which the machine is operated, a tangential component which is of the order of the peripheral velocity of the first-stage blade sector supplied with the working medium and finally the cross-sections of the spiral casings being dimensioned for different mass flow and the concentric annular openings having correspondingly different heights.

PRIOR ART

Power control of steam turbines is nowadays performed either via adaptation or throttling of the live-steam pressures, known as sliding-pressure control or throttle control, or by partial admission to an impulse stage designed especially for this purpose, via sectors, which can be shut off and controlled, of a nozzle ring. This type of control, known as nozzle group control, generally proves superior to pure nozzle control but, when the load and hence admission are reduced, leads to an increase in the loss components known by the term "partial-admission losses". In the event of incomplete intermixing of flow in the downstream wheel chamber, partial admission to the subsequent reaction blading and hence additional, large flow losses likewise occur.

Inlet casings with concentric annular ducts are disclosed in FR-A-2 351 249. The steam flows out of two axially directed, concentric annular ducts, which form a nozzle box, into an action wheel. The nozzles are arranged within the annular ducts. This is a conventional impulse control stage. The annular ducts are fed separately. One of the two annular ducts has two inflow lines, each leading to half of the circumference of the ring. The second annular duct has four inflow lines for its four segments. The power of the turbine is increased from idling to rated load by one annular duct first of all being fed over its entire circumference and then the various sectors of the second annular duct being opened one after the other. With this arrangement, there are supposedly no vibration problems at the first row of rotor blades in the case of partial admission.

An inlet casing of the type mentioned at the outset, with a type of control which leads to better efficiencies over the entire load range than with pure nozzle group control is disclosed in CH-A 654 625. Due to the admission over 360° of the circumference which occurs there with mass flows which vary according to the load, it is possible to dispense with the control stage comprising nozzle box and impulse wheel, which exhibits high losses at partial load. Particular advantages as regards construction are to be regarded as the fact that spiral casings of this kind have a short axial overall length and that only two steam-feed lines provided with shut-off and control elements are required.

If the cross-sections of the spiral casing are dimensioned for different mass flow, then, in addition to full load, it is possible to operate the machine unthrottled and thus with low losses at at least two partial-load levels. If, in addition, spiral cross-sections are designed to produce an angular momentum, it is possible to dispense with a deflecting grille in front of the first row of rotor blades of the turbine blading. Higher steam velocities than are customary are permissible in the inflow pipes since kinetic energy can be fully utilized for the production of an angular momentum. As a result, the inflow lines can be of a design which has small cross-sections and is thus cheaper.

DESCRIPTION OF THE INVENTION

It is the underlying object of the invention, in the case of an inlet casing of the type stated at the outset, to allow the retention of the previous conventional design with a control wheel operating on the impulse principle.

This is achieved according to the invention by the fact that the spiral which is dimensioned for the smaller flow and its annular opening is arranged on the rotor side in the radial direction, the first row of blading supplied from the annular openings is a row of rotor blades with a small degree of reaction, and the radially inner boundary wall of the spiral dimensioned for the small flow is arranged at least partially in the plane of the balance piston and is provided on its outside with a labyrinth-like shaft seal.

The advantage of the invention is to be regarded, in particular, as the fact that, by virtue of the large diameter of the control wheel, the balance piston required in single-flow turbine parts can be arranged in the free space within the spirals.

BRIEF DESCRIPTION OF THE DRAWING

An illustrative embodiment of the invention is depicted in simplified form in the drawing. The single FIGURE shows a partial longitudinal section through a turbine with a double-spiral inlet casing.

The direction of flow of the working medium, here high-pressure steam, is indicated by arrows. The figure does not claim to be accurate and is limited to the barest outlines for the purpose of easier comprehensibility.

ILLUSTRATIVE EMBODIMENT

The inlet casing comprises two spirals 1, 2, into which the steam flows via the pipe bends 8 and 9 respectively. The shut-off and control elements arranged in the pipe bends 8 and 9 are not shown. On the outlet side, the spirals each open into an annular opening 1' and 2' respectively. These annular openings are arranged concentrically to one another and extend over 360°. The delimitation of the flow from the two annular openings 1', 2' with respect to one another is effected via a short, common partition wall 4 extending axially into the turbine flow duct. In projection, the flow of steam into the turbine is thus axial from both spirals. Of the partially and very schematically sketched turbine, of which the single-flow high-pressure part is shown here, only the rotor 10 with the stuffing-box part 11 on the balance piston 17, the blade carrier 12, the control wheel 13, the fixed blades 14, secured in the blade carrier, of the three first reaction stages and the rotor blades 15, secured in the rotor, of the two first reaction stages are shown. Arranged between the outlet of the spirals 1, 2 —which is defined by the rear edge of the partition wall 4—and the control wheel 13 is an annular mixing chamber 5. Between the control wheel 13 and the row of fixed blades of the first stage is the customary wheel space 16. The radially inner boundary wall of the spiral 2 dimensioned for the small flow extends in the plane of the balance piston 17 and is provided on its outside with a labyrinth-like shaft seal, which is part of the said stuffing-box part 11.

Reduction pieces 6, 7 are provided between the inlet cross-sections (not shown) of the spirals, which are situated in the horizontal parting plane and the pipe bends 8, 9. In these reduction pieces, the working medium is accelerated from, for example, 60 m/s to the velocity required at the turbine inlet, in this case upstream of the control wheel 13, of, for example, 280 m/s. The production of angular momentum is effected in the spirals, which are of a design appropriate for this purpose. It is self-evident that velocities higher than the stated 60 m/s are also possible in the pipe bends 8 and 9. This is the case, in particular, because the kinetic energy can be fully utilized for the production of angular momentum. In the final analysis, it is a problem of optimization, in which the higher frictional losses due to increased velocity have to be weighed against a saving of material on the basis of smaller cross-sections.

The two spirals 1, 2, like their annular openings 1', 2' are arranged concentrically and likewise extend over 360° in the circumferential direction. Their inlet cross-sections are offset by 180° relative to one another, in such a way that flow through the spirals 1, 2 occurs in the same direction of rotation. These cross-sections are situated in the horizontal axis 3 of the turbine, i.e. in the plane in which the parting faces of the machine customarily extend.

The spiral cross-sections of the two concentrically arranged spirals 1, 2 are designed for unequal flow, and this explains the different inlet cross-sections 1'' and 2'' and the different heights of the duct or annular openings 1', 2'.

In addition to technical aspects relating to flow, structural and production aspects are to be taken into account in the selection of the cross-sectional shape. The aim will be to employ compact spiral shapes which guarantee as homogeneous an outflow as possible from the annular openings.

As regards this homogeneous outflow, it has already been explained above that the production of angular momentum takes place in the spiral itself. Due to the "Law of conservation of angular momentum", the reduction of the radius in the direction of flow imposes an additional acceleration on the working medium in the spiral. Taking into account this acceleration, the spiral cross-sections at each point are to be designed for an average velocity of, for example, 120 m/s. Absolute outflow velocities of about 280 m/s with an outflow angle of about 18° are then achieved at the correspondingly dimensioned annular openings. Given a corresponding peripheral velocity of the rotor at the decisive rotor diameter, this gives an ideal flow against the control wheel 13.

It has already been explained above that the acceleration otherwise performed in the nozzle of the control stage is effected principally in the reduction piece upstream of the spiral and to a small extent in the spiral itself. The stage drop reduction associated with this acceleration corresponds to the fraction of the drop which would have t be handled in the nozzle box, now omitted.

On the other hand, account should be taken of the fact that—in contrast to the solution indicated in CH-A-654 625 the first row of rotor blades to which the steam is admitted is that of a normal control stage. Due to the omission of the control stage and in the case of a predetermined overall drop across the high-pressure part of the turbine, the pressure level upon entry to the reaction blading is so high in the known solution that an additional reaction stage with a customary drop has to be provided to reduce it. This is due to the fact that only approximately half as much of the drop is customarily converted in a reaction stage as in an impulse stage provided for control purposes.

One of the principal advantages of the novel use of spirals can thus already be seen, i.e. the existing rotor can be taken over unaltered. This is particularly important with regard to the retro-fitting of existing turbines.

The spiral solution, which may be referred to as "angular momentum control", is particularly suitable in the partial-load mode of the turbine, where it has quite considerable advantages over the traditional nozzle group control. This is because the inflow to the first row of blades is always over 360° of the circumference at any load at which the machine is operated.

The provision of two spirals designed for different mass flow proves particularly favorable here. In the illustrative embodiment shown in which the "small" spiral 2 supplies those parts of the blades which are near to the rotor and the "large" spiral 1 supplies those parts of the blades which are nearest to the blade carrier 13–70% of the working medium flows out of annular opening 1' and 30% out of annular opening 2, in the case of full admission. It is thus possible to operate the machine at the following loads:

full load with open spirals 1, 2 and open control valves (not shown) in the pipe bends 8, 9;

70% partial load with open spiral 1 and closed spiral 2;

30% partial load with open spiral 2 and closed spiral 1;

any desired partial loads by opening one or both spirals and throttling one of the two valves (not shown).

Careful design of the spiral cross-section for the purpose of producing angular momentum and for the purpose of homogeneous outflow in the circumferential direction guarantees an identical angle of approach to the control wheel 13 to that in the case of full load even at partial-load levels of the turbine. The outflow velocity from the spirals, which vary according to the partial load, permit load control as in the case of nozzle group control.

In contrast to this conventional nozzle group control, in which the partial admission is effected in the circumferential direction, a partial admission in the radial direction is performed in the present case. This results in full admission in the circumferential direction at all times, resulting in a likewise uniform temperature distribution over the circumference. High-loss intermittent filling and emptying of the passages between blades, otherwise known in the case of partial admission, is thus dispensed with, with the result that the increase in the loss as the load decreases is smaller than in the case of nozzle group control. The dynamic stressing of the first row of rotor blades is furthermore more favorable.

An additional but significantly lower loss occurs in the case of partial load, only at the dividing front of the mass flows emerging from the annular openings 1' and 2' at different velocities. These are frictional and mixing losses at the jet boundaries. On the other hand, the setting back of the partition wall 4 in comparison with the existing solution according to CH-A-654 625 guarantees good intermixing of the part flows in the mixing chamber 5 at full load. Even when one of the spirals is completely shut off, the windage loss in the possibly unsupplied part of the blading is negligible. To keep this either unsupplied or differently supplied blade component as small as possible is the purpose of setting back the partition wall 4 and hence the formation of the abovementioned chamber 5. Their axial extension is chosen such that the compensation of the flow in the radial direction is promoted.

I claim:

1. Inlet casing for a single-flow, axial-flow high-pressure steam turbine having a balance piston, the flow to the first stage of which is from two mutually separated concentric annular openings, each annular opening being connected to its own inflow line, the inflow lines being two concentrically arranged spiral casings which can be shut off or throttled separately and are provided on the outlet side with annular openings extending over 360°, the spiral cross-section of both spirals furthermore being designed to produce an angular momentum over the entire circumference, such that the working medium flowing out of the annular openings has, irrespective of the load under which the machine is operated, a tangential component which is of the order of the peripheral velocity of the first-stage blade sector supplied with the working medium and finally the cross-sections of the spiral casings being dimensioned for different mass flow and the concentric annular openings having correspondingly different heights with an annular opening of one of the spiral casings being dimensioned for a smaller flow than the other of the spiral casings, characterized in that the annular opening of the spiral casing which is dimensioned for the smaller flow is radially arranged to be closer to the rotor than the other spiral casing, a first row of blading downstream from the annular openings is a row of rotor blades with a small degree of reaction, and a radially inner boundary wall of the spiral dimensioned for the small flow is arranged at least partially in the plane of the balance piston and is provided on its outside with a labyrinth-like shaft seal.

2. Inlet casing according to claim 1, characterized in that the spiral casings extend over 360° of the circumference and are provided with inlet cross-section offset by 180°.

3. Inlet casing according to claim 2, characterized in that the inlet cross-sections of the spirals are arranged in the horizontal axis (3) of the turbine.

4. Inlet casing according to claim 1, characterized in that, on the inlet side, the spiral casings are connected to the pipe bends on the inflow side via reduction pieces.

* * * * *